United States Patent [19]

Rose

[11] Patent Number: 4,555,970

[45] Date of Patent: Dec. 3, 1985

[54] TREMOLO APPARATUS CAPABLE OF INCREASING TENSION ON THE STRINGS OF A MUSICAL INSTRUMENT

[76] Inventor: Floyd D. Rose, 2727 NE. 145th, Seattle, Wash. 98155

[21] Appl. No.: 504,383

[22] Filed: Jun. 15, 1983

[51] Int. Cl.[4] ..... G10D 3/12

[52] U.S. Cl. ..... 84/313; 84/312 P

[58] Field of Search ..... 84/313, 298, 299, 312 R, 84/312 P

[56] References Cited

U.S. PATENT DOCUMENTS

| | | | |
|---|---|---|---|
| 2,741,146 | 4/1956 | Fender | 84/313 |
| 2,897,711 | 8/1959 | Matthew et al. | 84/313 |
| 3,248,991 | 5/1966 | Cole | 84/313 |
| 4,285,262 | 8/1981 | Scholz | 84/313 |

FOREIGN PATENT DOCUMENTS

| | | | |
|---|---|---|---|
| 2035651 | 6/1980 | United Kingdom | 84/312 P |

*Primary Examiner*—Lawrence R. Franklin

*Attorney, Agent, or Firm*—Lerner, David, Littenberg, Krumholz & Mentlik

[57] ABSTRACT

The tremolo apparatus of the present invention includes a tremolo means (13) with a tremolo bar (19) and a base flange (23) which extends into a cavity (21) in the guitar (11). When the tremolo means is operated conventionally, springs (25) return the tremolo means (13) to an original position against a stop (37) located in the cavity (21). Stop (37) is mounted for movement on rods (42 and 44) against the action of springs (47 and 49). When the tremolo bar (19) is moved toward the body of the instrument, such as a guitar, the tremolo means (13) moves in a first direction wherein the base flange (23) moves away from stop (37), while when the tremolo bar (19) is moved away from the body of the guitar, the tremolo means moves in a second direction wherein the base flange (23) moves stop (37) against the action of springs (47 and 49). Springs (47 and 49) return stop (37) and the base flange (23) and hence the tremolo means (13) to their original position when the tremolo bar is released.

22 Claims, 4 Drawing Figures

TREMOLO APPARATUS CAPABLE OF INCREASING TENSION ON THE STRINGS OF A MUSICAL INSTRUMENT

DESCRIPTION

1. Technical Field

This invention relates to the art of tremolos for string musical instruments.

2. Background of the Invention

Tremolos for string musical instruments are generally well-known and are typically used to significantly reduce the tension on all the strings of the instrument simultaneously, which produces rather unusual tone variations.

Tremolos are currently widely used on electric guitars. A tremolo is typically located in the vicinity of the bridge of the instrument, and is operated by pressing down on a tremolo bar, which extends slightly upwardly and forwardly from the body of the tremolo. An example of a typical tremolo is shown in U.S. Pat. No. 2,741,146 to Fender.

In operation, it is important that the tremolo always return to its original position after it has been actuated and then released. This is usually accomplished by a return mechanism comprising a spring acting on a base flange which extends into a cavity in the body of the guitar. This return mechanism is illustrated in the aforementioned U.S. Pat. No. 2,741,146. Sometimes, however, the original pitch of the strings is not achieved when the tremolo bar is released, because the springs do not return the tremolo exactly to its original position. It is certainly desirable to have the strings in tune when the tremolo is released.

Also, it has been recognized that in some situations it is desirable to increase, as well as decrease, the tension on the strings of an instrument simultaneously, so that the pitch of the strings is slightly sharp. Both of the above objectives are accomplished by the apparatus of the present invention.

DISCLOSURE OF THE INVENTION

Accordingly, the present invention includes a conventional tremolo means for simultaneously decreasing the tension on all the strings of a musical instrument by moving the tremolo apparatus from a first position to a second position through operation of the tremolo bar portion of the tremolo in one direction, which typically is toward the surface of the instrument. The conventional tremolo means includes means for returning the tremolo apparatus from its second position to its first position upon release of the tremolo bar. The invention further includes means for simultaneously increasing the tension on all the strings of the musical instrument by moving the tremolo apparatus to a third position through operation of the tremolo bar in a second direction, typically away from the surface of the instrument. Means are provided for returning the tremolo apparatus from its third position to its first position upon release of the tremolo bar.

BEST MODE FOR CARRYING OUT THE INVENTION

Figure 1:
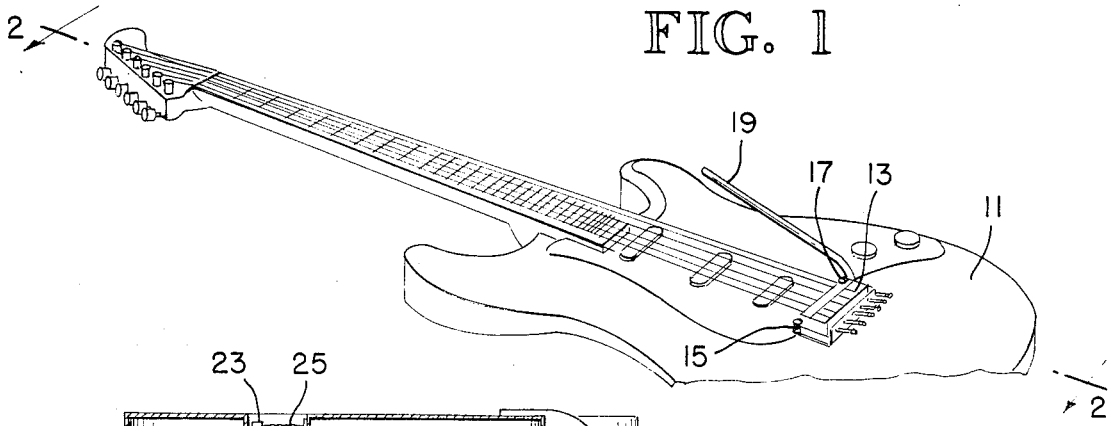
FIG. 1 is a perspective view of an electric guitar with a tremolo apparatus.

FIG. 1 shows a conventional guitar 11 having a tremolo apparatus 13. The portion of the tremolo 13 which is visible in FIG. 1 is for illustration only and could be substantially any tremolo configuration. The particular tremolo 13 shown forms the bridge of the instrument and includes means for securely holding each of the strings of the instrument. The tremolo 13 is pivoted about fixed pins 15 and 17 by means of a tremolo bar 19. The tremolo 13 is operated by pushing bar 19 toward the body of the guitar 11. This results in tremolo 13 pivoting about pins 15 and 17, which substantially reduces the tension on all the strings of the instrument simultaneously.

Figure 2:
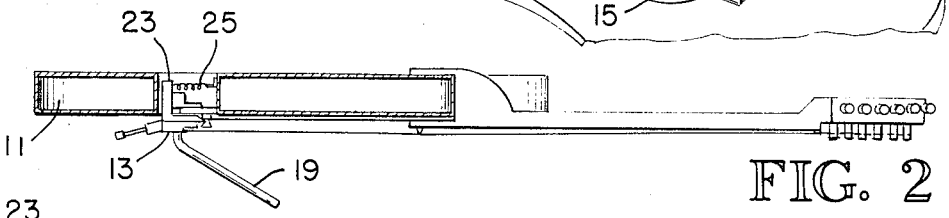
FIG. 2 is a cross-section view of the apparatus of FIG. 1, taken along lines 2—2 in FIG. 1.
Figure 3:
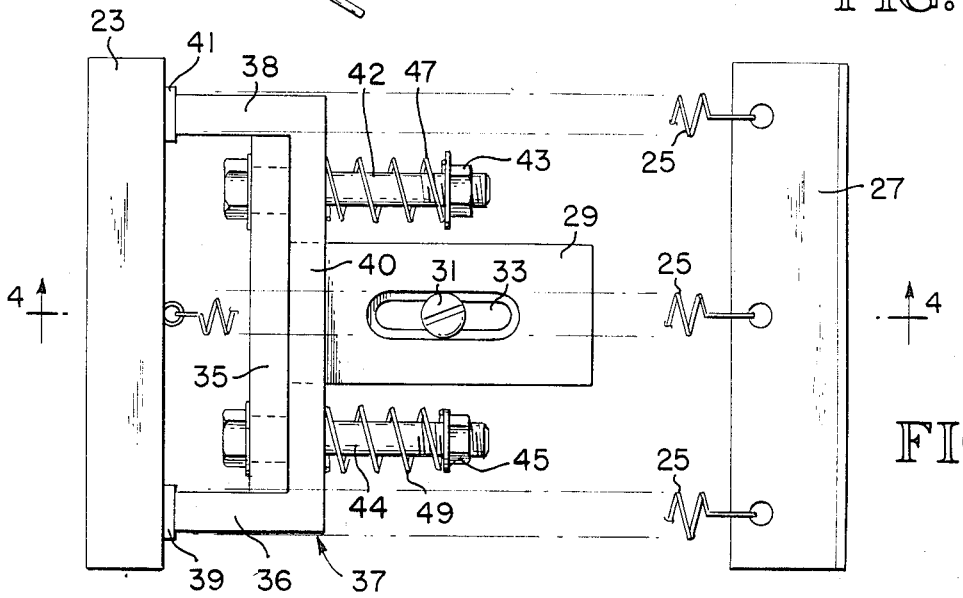
FIG. 3 is a plan view of the apparatus of the present invention, which is shown as part of FIG. 2.
Figure 4:
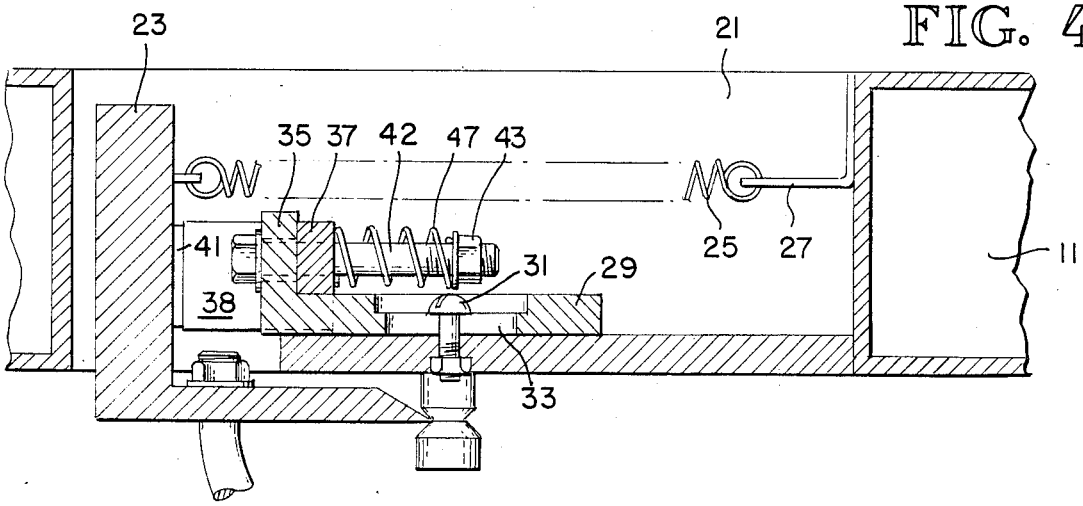
FIG. 4 is a cross-section view of the apparatus of FIG. 3, taken along lines 4—4 in FIG. 3, shown mounted in a guitar.

FIGS. 2, 3 and 4 show another conventional portion of the tremolo, as well as the apparatus of the present invention, which are concealed in a cavity 21 in the body of guitar 11. The conventional portion of the tremolo shown in FIGS. 2, 3, and 4 includes a base flange 23 which extends from that portion of the tremolo 13 shown in FIG. 1 into the guitar cavity 21, and a set of springs 25 which restrain the base flange 23 relative to a bracket 27 which is attached to the body of the guitar. In conventional operation of the tremolo 13, tremolo bar 19 is moved toward the surface of the guitar, against the action of springs 25, with the base flange 23 moving to the left in FIGS. 2 and 3. When the pressure on the bar 19 is released, the action of the springs 25 return the entire tremolo apparatus, including the base flange 23, to approximately its original position.

The apparatus of the present invention is shown most clearly in FIGS. 3 and 4. A base plate 29 is secured to the body of the guitar between anchor bracket 27 and base flange 23 by means of a screw 31, which extends through an elongated opening 33 in base plate 29. The elongated opening 33 permits the position of the base plate 29 to be adjusted longitudinally relative to the guitar.

Base plate 29 includes a rectangular flange 35 which extends at a right angle to base plate 29 at the end of the base plate nearest base flange 23. Base plate 29 in the embodiment shown is 1 inch long and 0.45 inches wide. Flange 35 is 1.150 inches long from side edge to side edge and 0.4 inches high, extending 0.2 inches outwardly from the upper surface of base plate 29. Thus the base plate 29 and flange 35 form a T shape in plan view. A squarish U-shaped stop 37 fits around flange 35, with the free ends of the respective legs 36,38 of stop 37 contacting base flange 23 through nylon bumpers 39 and 41. The distance between the two legs 36,38 of stop 37 is slightly greater than the length of flange 35, so that flange 35 fits within the stop 37, i.e. adjacent base portion 40 of stop 37, between the two legs 36, 38 thereof. The base of stop 37 is 1.65 inches long, from outside edge to outside edge, with the sides of the stop each being 0.5 inches, excluding the two nylon bumpers 39 and 41.

The flange 35 has openings near the opposite ends thereof, and stop 37 has openings in the base portion 40 thereof which are in registry with the openings in flange 35. In the embodiment shown, the openings are 0.16 inches in diameter. Bolts 42 and 44 are positioned through the openings in both the flange 35 and the stop 37 and extend at least an inch or so beyond stop 37 toward anchor bracket 27. Keepers 43 and 45 are positioned at the end of each bolt. Positioned between keepers 43 and 45 and stop 37 on each bolt are springs 47 and 49. The springs 47 and 49 are under compression, so that springs 47 and 49 tend to maintain the stop 37 in contact with the flange 35, which is fixed in position by virtue of base plate 29 and screw 31. With such an arrangement, nylon bumpers 39 and 41 are in a known position and act as an accurate stop for the base flange 23 of the tremolo and hence the tremolo itself.

In the conventional mode of operation of the tremolo, shown in the drawings, when bar 19 is moved toward the surface of the guitar, base flange 23 will move to the left in FIGS. 3 and 4, away from nylon bumpers 39 and 41 of stop 37, against the action of springs 25. This action results in a significant decrease in string tension. When the pressure on the bar 19 is released, the springs 25 return the base flange 23 and tremolo 13 to their original position against nylon bumpers 39 and 41. The strings also return to their original tension. The position of stop 37 and hence the position of the base flange 23 can of course be varied by loosening screw 31 and moving base plate 29.

In the other mode of operation of the tremolo shown in the drawings, the tremolo bar 19 is lifted up, away from the surface of the guitar. The base flange 23 will move toward the right in FIGS. 2 and 3, pushing stop 37 to the right along bolts 42 and 44, against the action of springs 47 and 49. This results in an increasing space between the otherwise contacting surfaces of flange 35 and stop 37, since flange 35 is fixed in position. This movement results in an increase in string tension, producing a "sharp" note. When the upward pressure on the bar 19 is released, the springs 47 and 49 urge stop 37 back against flange 35, which forces base flange 23 back to its original position. The strings return to their original tension and pitch.

Thus, a tremolo apparatus has been described which has the capability of increasing the tension on the strings of a musical instrument, thereby increasing the pitch of the strings, as well as the capability of operating in conventional fashion.

Although a preferred embodiment of the invention has been disclosed herein for illustration, it should be understood that various changes, modifications and substitutions may be incorporated in such embodiment without departing from the spirit of the invention which is defined by the claims which follow.

I claim:

1. A tremolo apparatus for a stringed musical instrument comprising:

tremolo means to which a plurality of strings of a musical instrument are adapted to be secured for movement therewith;

mounting means for mounting said tremolo means on a stringed musical instrument for movement from a first position to a second position to simultaneously decrease the tension of said plurality of strings, and for movement from said first position to a third position to simultaneously increase the tension of said plurality of strings;

tremolo moving means for moving said tremolo means from said first position toward said second position and for moving said tremolo means from said first position toward said third position;

a moveable stop member engageable with said tremolo means, said stop member being moveable between a first member position and a second member position displaced from said first member position, and said moveable stop member being arranged with respect to and cooperating with said tremolo means such that (i) said tremolo means is in said first position when said stop member is in said first member position and said tremolo means is in engagement therewith, (ii) said tremolo means is out of engagement with said stop member when said tremolo means is in one of said second and third positions, and (iii) said tremolo means is in engagement with said stop member and said stop member is in said second member position when said tremolo means is in the other of said second and third positions; and tremolo return means comprising first spring means urging said moveable stop member toward said first member position, and second spring means urging said tremolo means toward said stop member, whereby said tremolo means is normally positioned at said first position and is urged by said tremolo return means to return to said first position upon release of said tremolo moving means after having been moved to either of said second or third positions.

2. The tremolo apparatus of claim 1, further including a limit member engageable by said stop member for establishing said first member position of said stop member, said limit member being arranged with respect to said stop member so that said limit member is engaged by said stop member when said stop member is in said first member position and so that said first spring means urges said stop member into engagement with said limit member when said tremolo means is either in said first position or in said one of said second and third positions.

3. The tremolo apparatus of claim 2, wherein the position of said limit member is adjustable to thereby adjust said first member position of said stop member, and hence said first position of said tremolo means.

4. The tremolo apparatus of claim 3, further including adjustment means for adjustably mounting said limit member to said stringed musical instrument.

5. The tremolo apparatus of claim 2, in which the stringed musical instrument includes a cavity in the body thereof, wherein said tremolo means includes a flange which extends into said cavity when said mounting means mounts said tremolo means on the stringed musical instrument, and wherein said stop member engages a portion of said base flange when said tremolo means is in said first position and said stop member is in said first member position.

6. The tremolo apparatus of claim 5, wherein said stop member, said limit member, and said tremolo return means are located in the body of the stringed musical instrument.

7. The tremolo apparatus of claim 2, wherein said stop member is displaced out of engagement with said limit member when said stop member is in said second member position.

8. The tremolo apparatus of claim 7, wherein said limit member includes a flange portion and said stop member includes a base portion and a leg portion having a free end extending away from said base portion, said free end of said leg portion of said stop member engaging said tremolo means when said tremolo means is in said first position and said other of said second and third positions, and said base portion of said stop member engaging said flange portion of said limit member when said tremolo means is in said first position and said one of said second and third positions.

9. The tremolo apparatus of claim 8, wherein said stop member comprises a U-shaped stop member having a pair of leg portions having free ends extending away from said base portion of said U-shaped stop member, and wherein said tremolo means includes a base flange and said free ends of said leg portions engage said base flange of said tremolo means when said tremolo means is in said first position and said other of said second and third positions.

10. The tremolo apparatus of claim 9, wherein said first spring means comprises compression spring means acting in compression to urge said base portion of said U-shaped stop member against said flange portion of said limit member.

11. The tremolo apparatus of claim 10, further including rod means extending through said flange portion of said limit member and said base portion of said U-shaped stop member, and wherein said compression spring means are mounted on said rod means for urging said base portion of said U-shaped stop member against said flange portion of said limit member.

12. The tremolo apparatus of claim 11, wherein said second spring means comprise tension spring means acting in tension to urge said base flange of said tremolo means toward said free ends of said leg portions of said U-shaped stop member.

13. The tremolo apparatus of claim 12, wherein said tension springs are secured to said base flange and to said stringed musical instrument.

14. The tremolo apparatus of claim 1, wherein said one of said second and third positions of said tremolo means in said second position, and said other of said second and third positions of said tremolo means is said third position.

15. The tremolo apparatus of claim 14, wherein said tremolo moving means comprises a tremolo bar, said tremolo bar being operable in a first direction to move said tremolo means from said first position toward said second position and being operable in a second substantially opposite direction to move said tremolo means from said first position towards said third position.

16. The tremolo apparatus of claim 15, wherein said first direction of movement of said tremolo bar is toward the surface of said stringed musical instrument and said second substantially opposite direction of movement of said tremolo bar is away from the surface of said stringed musical instrument.

17. A stringed musical instrument, comprising:

a body;

a plurality of strings each having a first end secured to said body and a second end;

tremolo means to which said second ends of said strings are secured for movement therewith;

mounting means for mounting said tremolo means on said body for movement from a first position to a second position to simultaneously decrease the tension of said plurality of strings, and for movement from said first position to a third position to simultaneously increase the tension of said plurality of strings;

tremolo moving means for moving said tremolo means from said first position toward said second position and for moving said tremolo means from said first position towards said third position; a moveable stop member engageable with said tremolo means, said stop member being movable between a first member position and a second member position displaced from said first member position, and said moveable stop member being arranged with respect to and cooperating with said tremolo means such that (i) said tremolo means is in said first position when said stop member is in said first member position and said tremolo means is in engagement therewith, (ii) said tremolo means is out of engagement with said stop member when said tremolo means is in one of said second and third positions, and (iii) said tremolo means is in engagement with said stop member and said stop member is in said second member position when said tremolo means is in the other of said second and third positions; and tremolo return means comprising first spring means urging said moveable stop member toward said first member position, and second spring means urging said tremolo means toward said stop member, whereby said tremolo means is normally positioned at said first position and is urged by said tremolo return means to return to said first position upon release of said tremolo moving means after having been moved to either of said second or third positions.

18. The stringed musical instrument of claim 17, wherein said body comprises a guitar body, and wherein said first ends of said strings are secured to said guitar body adjacent the head end thereof.

19. The stringed musical instrument of claim 18, wherein said mounting means mounts said tremolo means on said guitar body for pivotable movement between said first position and said second position and between said first position and said third position.

20. The stringed musical instrument of claim 19, wherein said tremolo means forms the bridge of said guitar body and includes means for securely holding said second ends of said plurality of strings.

21. The stringed musical instrument of claim 17, further including a limit member engageable by said stop member for establishing said first member position of said stop member, said limit member being secured to said body and arranged with respect to said stop member so that said limit member is engaged by said stop member when said stop member is in said first member position and so that said first spring means urges said stop member into engagement with said limit member when said tremolo means is either in said first position or in said one of said second and third positions.

22. The stringed musical instrument of claim 21, wherein said limit member is adjustably mounted to said body to thereby adjust the location of said first member position of said stop member, and hence said first position of said tremolo means.

* * * * *

UNITED STATES PATENT AND TRADEMARK OFFICE

CERTIFICATE OF CORRECTION

PATENT NO. : 4,555,970

DATED : December 3, 1985

INVENTOR(S) : Floyd D. Rose

It is certified that error appears in the above-identified patent and that said Letters Patent is hereby corrected as shown below:

Column 4, line 47, after "a", insert --base--.
Column 5, line 36, "in" should read --is--.

Signed and Sealed this

*Fifteenth* Day of *April 1986*

[SEAL]

*Attest:*

DONALD J. QUIGG

*Attesting Officer*

*Commissioner of Patents and Trademarks*